United States Patent [19]

Mills, Jr.

[11] 4,365,160

[45] Dec. 21, 1982

[54] BRIGHTNESS ENHANCEMENT OF POSITRON SOURCES

[75] Inventor: Allen P. Mills, Jr., New Providence, N.J.

[73] Assignee: Bell Telephone Laboratories, Incorporated, Murray Hill, N.J.

[21] Appl. No.: 165,379

[22] Filed: Jul. 2, 1980

[51] Int. Cl.[3] ..... G21K 1/08

[52] U.S. Cl. ..... 250/396 R; 250/503.1; 376/913

[58] Field of Search ..... 376/156, 913; 250/396 R, 396 ML, 398, 503

[56] References Cited

U.S. PATENT DOCUMENTS 2,974,280 3/1961 Hoover ..... 376/913

OTHER PUBLICATIONS

Appl. Phys. Lett., vol. 35, pp. 427–429 (9/1/79) Mills.

Intro. to Electron and Low Optics, Academic Press, N.Y., pp. 11–13 and pp. 19–22 (1973).

Statistical Physics, Addison-Wesley (1969) Landau et al., pp. 9 & 10.

*Primary Examiner*—S. A. Cangialosi

*Attorney, Agent, or Firm*—Richard D. Laumann; Peter V. D. Wilde

[57] ABSTRACT

Disclosed is a method and apparatus for enhancing the brightness of both continuous and pulsed positron beams. By subjecting positrons to non-conservative forces in an interaction region, typically by means of a positron moderator such as a single crystal Cu(111)+S moderator, it is possible to circumvent the limitation, expressed in Liouville's theorem, of the optimally achievable brightness of a beam. The inventive method can be applied in successive stages involving accelerating and focusing a moderated positron beam, and moderating the energetic positrons to thermal energies, resulting typically in an increase in brightness by a factor of about 100 per stage, with an attendant reduction of flux by about factors of ten or less.

18 Claims, 5 Drawing Figures a)
b)
$d_0$
$d_f$
$\theta_0\sqrt{E_0}$
$\theta_f\sqrt{E_f}$ a)
b)
c)
d)
$d_0$
$d_f$
$d'_0$
$d'_f$
$\theta_0\sqrt{E_0}$
$\theta_f\sqrt{E_f}$
$\theta'_0\sqrt{E'_0}$
$\theta'_f\sqrt{E'_f}$

BRIGHTNESS ENHANCEMENT OF POSITRON SOURCES

BACKGROUND OF THE INVENTION

1. Field of the Invention

This invention relates to positron beams and employs a radiation modifying member.

2. Description of the Prior Art

Although positrons were discovered almost fifty years ago, only recently has it become possible to use low-energy positrons as a research tool in any significant way. Partly responsible for this long hiatus has been the difficulty in obtaining sufficiently intense, well-characterized beams of positrons. If such beams could be produced they would be very useful, for instance, for solid state, surface, and plasma studies, for use in storage rings and the like in high-energy physics, and for possible devices.

Recent theoretical and experimental advances have made it possible to obtain well-characterized positron beams, which in this context essentially means quasimonoenergetic positrons. This is generally achieved by means of an efficient moderator. See for instance, A. P. Mills, Jr., *Applied Physics Letters,* Vol. 35, Sept. 1, 1979, pp. 427–429, where a single crystal copper moderator activated with about a ⅓ monolayer of sulfur is discussed. Briefly, positrons from a radioactive source (e.g., $^{58}Co$) or other appropriate source are caused to impinge on the activated (111) surface of a highly perfect copper single crystal. After thermalizing in the solid, some of the positrons diffuse back to the surface, where a sizable fraction of them is emitted from the solid, because the described surface has negative affinity for positrons. The emitted thermal positrons have a very small energy spread, of the order of a fraction of one eV. Typically, when a moderator of this kind is used, one obtains a slow positron flux of the order of $10^{-3}$ of the radioactive source positron activity. The area of the moderator which is emitting slow positrons is of necessity larger than the area of the radioactive source, which must have an area of several $mm^2$/Curie of activity to insure that the low-energy end of the positron spectrum is not self-absorbed by the source. This large spot size is a severe limitation on the achievable brightness of slow positron beams, i.e., moderated positron beams. I am using "brightness" here in its usual electron-optical sense, namely, "flux/sterad of angle subtended by the beam." Quantitatively, it is defined as follows: let the z-direction of a cartesian coordinate system be oriented along the beam direction. If N particles/unit time pass through a plane normal to z at $z_f$, "brightness" or "luminosity" of the beam at $z_f$ is defined as $$\beta(z_f) = \frac{N}{\omega_{xy}(z_f)},$$

where $\omega_{xy}(z_f)$ is the beam emittance, $$\omega_{xy}(z_f) = \int_{z_f} \Omega(x,y)dxdy,$$

with $\Omega(x,y)$ being the solid angle subtended by the particle trajectories through the point $(x,y,z_f)$, and the integral is over the plane $z=z_f$. See for instance, P. Dahl, *Introduction to Electron and Ion Optics,* Academic Press, New York (1973), pp. 11–12.

Optimally achievable beam parameters can be determined from the characteristics of the beam as it is emitted from the moderator surface, since the quantity $\theta d\sqrt{E}$ is conserved, as will be discussed in more detail below. Here $\theta$ is the angle of divergence of the beam, d the beam diameter, and E the beam energy. For instance, to study positron diffraction from surfaces, one typically needs $\theta \sim 1°$, $d \sim 1$ mm, and $E \sim 25$ eV. If one starts with a moderated positron beam having $E \sim 0.25$ eV, $d \sim 6$ mm and $\theta \sim 60°$, as occurs in a typical situation, then it is easy to see that, in order to achieve the required beam parameters, an aperture has to be employed that results in a roughly thousandfold reduction of flux.

No known method for improving the achievable brightness by means of electron optics and the like exists, since the limitation expressed in the conservation of $\theta d\sqrt{E}$ is a fundamental one, derived from Liouville's theorem. As was indicated above, the unavailability of high-brightness, well-characterized positron beams has limited the application of positrons as research tools unitl now.

SUMMARY OF THE INVENTION

As is well known, Liouville's theorem, which is applicable to systems that are subject to conservative forces, expresses the property of such systems commonly referred to as "conservation of phase space volume," namely, conservation of the phase space volume occupied by the ensemble of system points. Since, as a consequence of this conservation, the achievable brightness of positron beams is limited by the initial beam parameters, a method for circumventing the restriction expressed in Liouville's theorem is of considerable interest. This, inter alia, is the subject matter of my invention.

As was indicated above, Liouville's theorem applies to systems that are subject to conservative forces only. Subjecting a positron beam in an interaction region to appropriately chosen nonconservative forces thus permits escape from the restriction imposed by the theorem, and, according to this invention, results in greatly increased brightness of such a positron beam.

The interaction of a positron beam with a moderator is nonconservative, and thus adapted to the above-indicated purpose. Low-energy positrons emitted from a moderator can be accelerated into the keV energy range, and focused by well-known electron-optical methods to a focal spot of the order of 0.1 mm diameter. Note that such focusing increases, of course, the flux/unit area at the focal point, but does not result in an increase in brightness of the beam. If a second moderator is located at the site of the focus then a certain fraction, of the order of about one-third, of the incident positrons will be re-emitted as a new slow positron beam. This beam can then be accelerated and focused without the use of apertures to, e.g., $E=25$ eV, $\theta=1°$, $d=1$ mm, and thus be directly useful for diffraction studies. The net gain in brightness is of the order of 100 over the single moderator. This process of accelerating and focusing, moderating, re-accelerating and re-focusing can be repeated in further stages, each stage resulting in a brightness increase of the order of 100 over the beam in the previous stage, until the focal spot diameter approaches the diffusion length of positrons in the moderator, about $10^3$ to $10^3$ Å.

DETAILED DESCRIPTION

Figure 1:
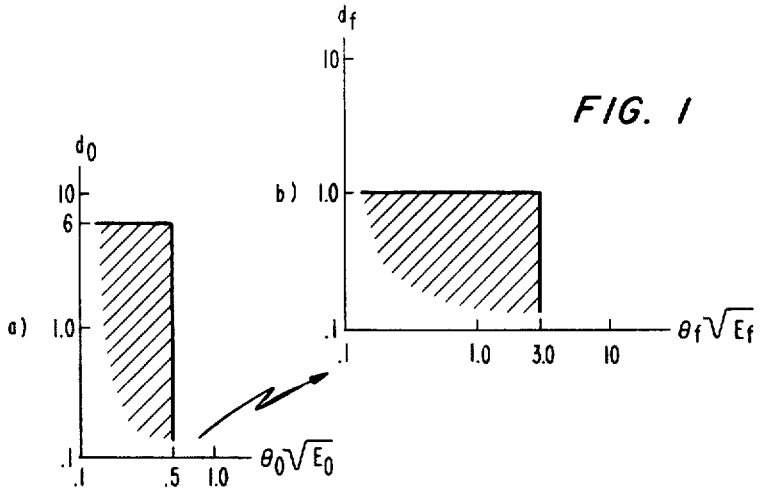
FIG. 1 is a schematic illustration of the evolution in phase space of a prior art system.

Central to an understanding of my invention is an appreciation of Liouville's theorem, a derivation of which can be found in most books on statistical mechanics. See for instance, L. Landau and E. M. Lifshitz, *Statistical Physics*, Addison-Wesley, 1969, pp. 9 and 10.

Several common ways of interpreting the theorem exist. For my purposes, it is convenient to essentially follow a discussion in P. Dahl, op. cit., pp. 19–22, which is incorporated herein by reference. Briefly, Liouville's theorem states that the phase space volume occupied by the ensemble of phase space points representing a system subject to conservative forces only is conserved. Under some special circumstances the conserved volume of phase space $\tau$, to be denoted $\tau_{xyz}$, is a product of separately conserved phase space volumes, namely, $\tau_{xyz}=\tau_x\tau_y\tau_z$ where by $\tau_x$, for instance, I mean the projection of $\tau_{xyz}$ onto the $xp_x$ plane, where $p_x$ is the x-component of the linear momentum. One of the systems for which this is true is a system consisting of noninteracting particles subject only to conservative forces. The densities in the particle beams of interest here are typically so low that particle interactions can be neglected. But, in any case, one can show that particle interactions can be taken into account by means of a mean field. In either case, phase space can be factored into three separately conserved partial phase space volumes, and I will henceforth only be concerned with $\tau_x\tau_y$ or, alternatively, since systems of interest here typically have axial symmetry, with $\tau_r$, the "transverse" phase space volume.

Although phase space is usually expressed in terms of position and momentum coordinates, it can be transformed to other coordinates without in any way impairing the validity of the above-mentioned conclusions. For the present purpose, it is convenient to express momentum in terms of the particle energy and the angle of divergence of the particle trajectory from the z-axis. It will be noted that for nonrelativistic particles the square root of the particle energy is proportional to the particle velocity, and the square root of the energy times sin $\theta$ is proportional to the radial velocity, and thus the radial momentum of the particle, in a system having axial symmetry. From this it follows that for a particle beam originating at some emitting surface of finite area, having a finite divergence and energy, and subject only to conservative fields such as accelerating electric fields or guiding electric or magnetic fields, the following equality holds:

$$\sqrt{E_o}\ d_o\sin\theta_o = \sqrt{E_f}\ d_f\sin\theta_f. \tag{1}$$

In this equation, subscripts o refer to the emitter, and f to any other point, as for instance, the focal point of the beam. For simplicity's sake, I will henceforth approximate sin $\theta$ by the angle of divergence, recognizing that this is strictly permissible only for small $\theta$, but the order-of-magnitude arguments to be made here are valid even if $\theta$ is of order unity. This results in $$\theta_o d_o\sqrt{E_o} = \theta_f d_f\sqrt{E_f}\ , \tag{2}$$

as was to be shown.

The above discussion implies conservation of beam brightness in a system in which no particles are lost from the beam, namely, $\beta(z_o)=\beta(z_f)$. I would like to emphasize that this conclusion is independent of any possible focusing schemes involving only conservative forces.

FIG. 1 schematically shows the evolution of a beam emitted from an emitter area of six millimeter diameter, energy of 0.25 eV, with a divergence of approximately 1 radian, as would be typical for a positron moderator. The beam, after having been accelerated to 25 eV and focused to a beam diameter of 1 mm, is seen to have a divergence of approximately 0.6 radian. As was pointed out earlier, such a beam divergence is unacceptable for, e.g., surface studies, where a divergence of the order of 1°, i.e., 1/50 radian, is required. Consequently, an aperture would have to be inserted, which would appropriately reduce the beam divergence, but of course, also eliminate all but aproximately 0.1 percent of the flux.

Figure 2:
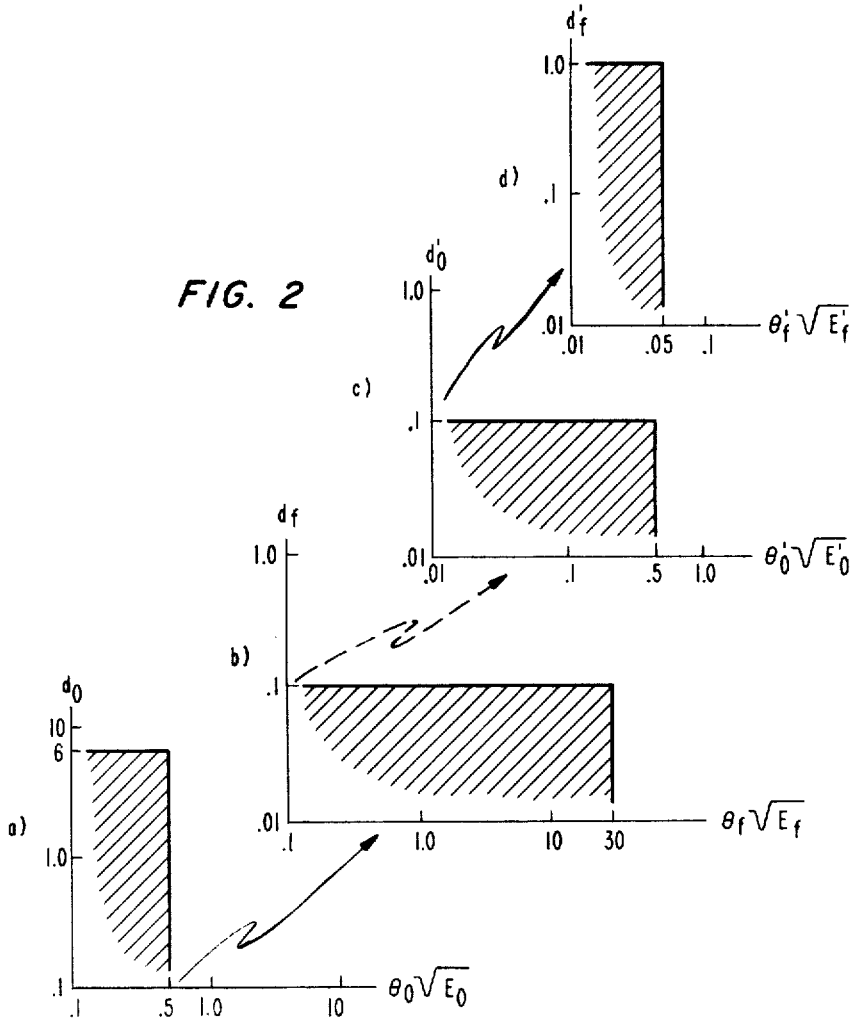
FIG. 2 is a schematic illustration of the evolution in phase space of a system according to the invention.

FIG. 2 shows schematically the effect of subjecting a particle beam, typically a positron beam, to appropriate nonconservative forces. A beam identical to that assumed in FIG. 1 is to be accelerated to a high voltage, e.g., 3 keV, and focused to a beam diameter of 0.1 mm. The resulting phase space volume is shown in diagram (b) of FIG. 2. Subjecting this beam to nonconservative forces in an interaction region close to the focal point, as for instance, by focusing the beam on a positron moderator, results in a changed phase space volume. A moderator having characteristics similar to the one used to prepare the original beam will result in the situation shown in diagram (c) of FIG. 2, namely, an emitted beam having approximately 0.1 millimeter beam diameter at the emitting surface, about 1 radian divergence, and an energy of about 0.25 eV. As can be seen from this, the nonconservative interaction has resulted in a decrease of phase space volume by a factor of about 60. This new beam can then be accelerated and focused to result in the situation shown in diagram (d) of FIG. 2, namely, a beam of 1 mm diameter, about 0.01 radian divergence, and 25 eV. Such a beam is directly usable for surface studies and similar purposes.

The best currently available moderators will result in a loss of about two-thirds of the incident flux of 3 keV positrons. In particular, it has been shown that if positrons of energy E are implanted in the moderator crystal, then the fraction of positrons which diffuse back to the surface is approximately $(1+E/E_o)^{-1}$, where $E_o$ is approximately 8 keV for copper. Furthermore, appropriate Cu(111)+S surfaces have the property that about half of the positrons which diffuse to the surface are re-emitted as slow positrons. These two characteristics together result in the above indicated loss of about two-thirds of the flux. Comparing this, however, with the prior art situation as illustrated by FIG. 1, we see that the use of the second moderator has resulted in a net gain of about a factor of 300 in the flux available to the experimenter.

Figure 3:
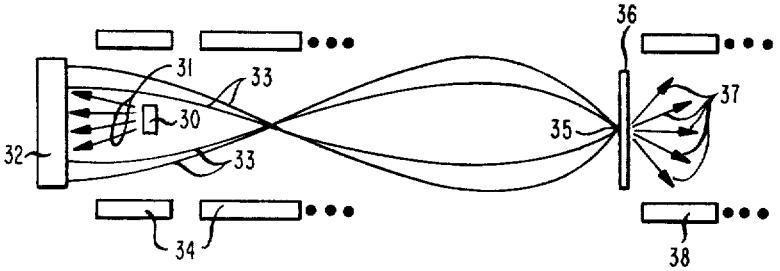
FIG. 3 is a schematic representation of a first embodiment of the invention.

FIG. 3 schematically shows an embodiment of the inventive method. A positron source 30, for instance, a $^{58}Co$ source, emits energetic positrons 31 having a substantial energy spread. The source is arranged such that a large fraction of the emitted positrons impinges upon moderator 32, typically a high efficiency Cu(111)+S moderator, although the inventive method is not limited to the use of any particular moderator, and, more generally, is not limited to the use of any particular method for subjecting the particle beam to nonconservative forces. As was described above, such a copper moderator results in the re-emission of a slow positron beam having an energy spread of approximately 0.25 eV, a beam divergence of approximately 1 radian, and a total flux of the order of $10^{-3}$ of the total activity of a properly placed $^{58}Co$ source. This emitted beam 33 is accelerated to several keV and focused by electrodes 34, the beam being caused to come to a focus 35 approximately on the surface of transmission-type moderator 36. Typically, such a moderator consists of a thin layer of the moderating substance, deposited either on a very thin relatively transparent substrate, or mesh-supported. A possible substrate material is cleaved mica, and an epitaxial layer of Cu(111) can be grown thereon, resulting in an efficient moderator, provided the thickness of the copper layer is appropriately chosen. Briefly, the layer thickness should exceed only slightly the penetration depth of positrons of the appropriate incident energy. Such a moderator results in the emission of a slow positron beam of similar energy, energy spread, and divergence as the beam emitted from the reflection-type moderator 32, but, because most of the positrons impinging on moderator 36 stop within approximately a diffusion length of the emitting surface, the efficiency of the moderating process is much higher, resulting in an emitted moderated flux of the order of one-third of the incident flux. The moderated positrons 37 can again be accelerated, focused, and the like by electrodes 38. It should be noted that instead of reflecting-type moderator 32, a transmission type moderator could be used, and vice versa. The changes in the geometry of the apparatus required would be obvious to one skilled in the art.

As was already pointed out above, for practical reasons typical positron sources have emitting areas of fairly large size, of the order of a few millimeters in diameter. The emitting area of the first moderator, such as for instance, moderator 32, of FIG. 3, will of necessity be somewhat larger than the emitting source area. Using well-known electron-optical practices, a monoenergetic beam emitted from such an area can be brought to a focus of the order of 0.1 mm diameter. In an arrangement similar to that shown in FIG. 3, the second moderator 36 has an emitting area of approximately the same size as the focal area, since the spreading of the beam size during moderating is typically no more than the diffusion length of positrons in the moderator, of the order of $10^3$ to $10^4$ Å. The process of accelerating, focusing, and moderating can be repeated one or several more times, and will typically conservatively result in a gain in brightness of the order of 100 and a decrease in flux of the order of one-tenth per stage. No further gain in brightness results once the diameter of the focus spot approaches the diffusion length of positrons in the moderator.

Figure 4:
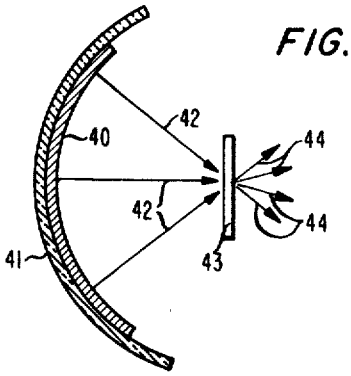
FIG. 4 is a schematic representation of a further embodiment of the invention.

FIG. 4 shows schematically another possible embodiment of the inventive method that can be used to produce a very intense positron beam if a source of neutrons is available, such as, for instance, a nuclear reactor. As is well known, one can make very intense positron sources by appropriate neutron activation. As an example, a thin layer of matrix material 40, for instance copper, containing activated atoms, for instance $^{64}Cu$, is deposited on a thin substrate 41, for instance, a cleaved mica substrate, the layer thus forming a positron source. The substrate is advantageously arranged in a nonplanar geometry, for instance, in segments having spherical or cylindrical curvature, thereby concentrating the beam of positrons 42 emitted from the source layer. The source layer 40 can simultaneously function as primary moderator, if, for instance, the copper film is epitaxially grown Cu(111). Such epitaxial growth is, for instance, accomplished by deposition of copper on a hot mica substrate, and is advantageously carried out in high vacuum. The activation of the moderator surface is typically achieved by exposing the substrate/film system briefly to $H_2S$, or other appropriate sulfur-containing medium. If a self-moderating source is used, then the emitted slow positrons are advantageously accelerated towards the secondary moderator 43, thereby increasing the efficiency of collection. The slow positrons 44 that are emitted from the secondary moderator 43 are then to be used in analogous fashion to that described in the previous example.

As an example of the positron flux achievable in such a scheme, assume that a neutron flux of $10^{15}$ neutrons/cm$^2$ sec is available to activate the Cu before evaporating it onto the mica substrate. If the source layer is 10 μm thick the activity is about 60 Ci/cm$^2$. Thus, a 30 cm diameter hemispherical source is expected to yield a total equilibrium activity of about 40 kCi. Following two stages of brightness enhancement according to the invention, the beam is typically concentrated to about 0.2 mm diameter, with a flux of about $3\times10^{11}$ positrons per second, constituting roughly a 50 nanoampere positron current. Such a large current is useful, for instance, for pumping a storage ring.

The activation of the source can, of course, also be achieved in situ by exposing the source layer to an appropriate neutron flux. However, the resulting high density of lattice defects in the moderator layer can be expected to impair the self-moderating capability of the layer.

It is also possible to combine the brightness enhancement scheme disclosed here with methods for time bunching of slow positrons, i.e., transforming an essentially continuous positron stream into a succession of short positron pulses, resulting in greatly increased instantaneous flux. The time bunching can be effected in a number of ways. If a time dependent voltage $V(t)=(\frac{1}{2})ml^2t^{-2}$, with $t_{max}\leqq t<0$, is applied along a section of positron drift tube of length l, where m is the positron mass, then the monoenergetic positrons contained within this length of tube will arrive substantially simultaneously at $t=0$ at the end of the acceleration path. For instance, low energy positrons emitted from a moderator could be accelerated by such a field and be caused to impinge on a second moderator, or to be directly used. A similar method for achieving time bunching depends on the acceleration of essentially monoenergetic particles by a suddenly applied potential pulse that has constant amplitude for $0\leqq t\leqq t_{max}$, but varies quadratically with distance z from the target, i.e., $V(z)=kz^2$. The width of the pulse must be greater than $(\pi/2)\sqrt{m/k}$ to ensure collection of all the particles. In this case, all the particles present between $z=0$ and $z=z_{max}$ at $t=0$ arrive at the target at $z=0$ substantially simultaneously. Both these methods result in an increase in instantaneous beam flux by a factor approximately equal to the maximum value of the applied potential to the initial positron energy in eV.

Figure 5:
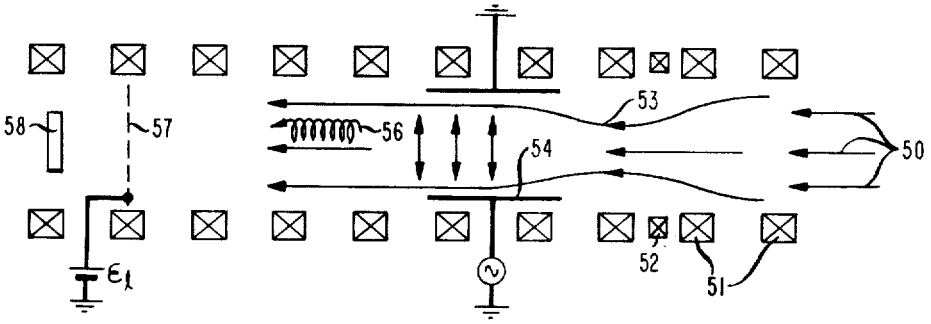
FIG. 5 is a schematic representation of a scheme for time-bunching of a beam of charged particles.

A third bunching method is illustrated in FIG. 5. The purpose of the scheme is first to trap a large number of charged particles, such as, for instance, positrons, in a magnetic bottle. Having collected a sufficient number of particles, a time-varying potential as described above is turned on along an acceleration region to collect all the particles simultaneously at a target. The theoretical flux gain of this scheme is approximately the square of that achievable by the two above-described methods.

FIG. 5 will be discussed in terms of positrons, but it will, of course, be recognized that the scheme disclosed here is not so limited. The exemplary apparatus is shown to have a linear layout, but this is, of course, not essential. However, such apparatus typically is laid out such that the positrons traverse it substantially longitudinally from an entrance side to an exit side. Substantially monoenergetic positrons 50 enter at the entrance side a drift region, in which solenoids 51 maintain a constant longitudinal magnetic field of field strength $B_o$. Over a small fraction 53 of the drift distance an additional longitudinal field is maintained, for instance, by additional solenoid 52, resulting in a so-called magnetic mirror configuration. If the magnetic mirror field is $B_m$, then it is well known that the magnetic mirror transmits a charged particle if the ratio of longitudinal to transverse energy of the particle is greater than $(B_m/B_o-1)$, i.e., the mirror is transparent for particles having relatively small transverse velocities. The particles that are transmitted through the magnetic mirror enter RF cavity 54, which is driven at the positron cyclotron resonance frequency, with an amplitude adjusted to impart a transverse energy equal to $\eta\epsilon_l$ the first time a positron enters the cavity from the mirror region. $\epsilon_l$ is defined by the condition that grid 57 is adjusted to repel positrons of longitudinal energy $\leqq\epsilon_l$ and $\eta$ is a design factor, of order unity, to be determined later. After transverse accleration in the RF cavity, the positrons 56 spiral towards grid 57, where they are repelled. They thus return to the cavity, receiving there additional transverse acceleration, and continue their spiral trajectory to the mirror region, where they are again reflected. This process will be repeated a number of times, depending on the value $\eta$ chosen. It can be shown that the mean number of reflections before leaking from the bottle is about $(9\eta)^2$, and the transverse energy spread of the positrons in the "bottle" about $90\eta^2\epsilon_l$. Thus, if $\eta$ is chosen to be 2, and $\epsilon_l$ is 0.25 eV, the transverse energy spread will be about 90 eV after about 320 reflections, implying that with such a design one is able to produce at the target 58 situated at the exit side 10 nanosecond pulses containing typically $10^2$–$10^3$ positrons from a continuous flux of about $10^6$ positrons/sec entering the apparatus at the entrance side. As indicated above, such pulses can be either further moderated, accelerated, focused and the like, or can be used directly. Detailed information on these time-bunching schemes can be found in A. P. Mills, Jr., "Time-Bunching of Slow Positrons for Annihilation Lifetime and Pulsed Laser Photon Absorption Experiments," *Applied Physics*, Vol. 22, to be published, incorporated herein by reference.

All the schemes described above can also be applied to electrons, provided a proper moderator is used. Such a moderator could be constructed from a negative-affinity GaAs:CsO surface.

The examples and design criteria given above only exemplify possible applications of the inventive method, and the scope of the invention is defined only by the claims.

I claim:

1. Method for producing a substantially monoenergetic low-energy beam of positrons comprising (a) accelerating at least part of the low-energy beam to an energy substantially greater than the initial low energy of the beam, (b) causing at least part of the accelerated beam to enter into an interaction region adapted to subject the beam to non-conservative forces, characterized in that the method further comprises (c) arranging the interaction region such that at least part of the beam that enters the region is again emitted from the region, the positrons in the emitted beam having substantially less energy after being emitted from the region than before entering it, and (d) accelerating at least part of the beam emitted from the interaction region to an energy substantially greater than the energy of the beam after emission from the interaction region.

2. Method of claim 1 wherein the interaction region is the surface and volume of a positron moderator.

3. Method of claim 2 wherein the positron moderator is an activated monocrystalline moderator.

4. Method of claim 3 wherein the moderator is a Cu(111)+S moderator.

5. Method of claim 1 wherein the positron source comprises radioactive atoms having a positron-emitting decay mode, the atoms being contained in a matrix material.

6. Method of claim 5 wherein the radioactive atoms are $^{58}Co$.

7. Method of claim 1 wherein the positron source comprises neutron-activated atoms having an excited state that has a positron-emitting decay mode, the atoms being contained in a thin layer of matrix material.

8. Method of claim 7 wherein the atoms are $^{64}Cu$.

9. Method of claim 7 wherein the positron source consists of at least one segment having spherical curvature.

10. Method of claim 7 wherein the positron source consists of at least one segment having cylindrical curvature.

11. Method of claim 1 wherein at least part of the moderated positron beam is subjected to time-varying electric potentials adapted to result in the transformation of the essentially continuous positron beam into a succession of positron pulses.

12. Method of claim 11 wherein the time-varying electric potential consists of potential pulses $V(t)=(\frac{1}{2})m_l^2t^{-2}$, where m is the positron mass, t is the time, with $t_{max}\leqq t\leqq 0$ for each pulse, and V(t) is applied along an acceleration path of length l, at the end of the acceleration path being a target, whereby the positrons present within l at $t=t_{max}$ will arrive substantially simultaneously at the target at $t=0$.

13. Method of claim 11 wherein the time-varying electric potential consists of potential pulses of constant amplitude for $0\leqq t\leqq t_{max}$, and duration greater than $(\pi/2)\sqrt{m/k}$, where m is the positron mass and k an arbitrary constant, the potential varying spatially according to $V(z)=kz^2$ along an acceleration path of length l, at the end of the acceleration path being a target at $z=0$, where z is the distance along the beam axis, whereby the positrons present within l at $t=0$ will arrive substantially simultaneously at the target.

14. Apparatus for producing a substantially monoenergetic low-energy beam of positrons comprising (a) means for accelerating at least part of the low-energy beam to an energy substantially greater than the initial low energy of the beam, (b) means for subjecting in an interaction region the accelerated beam to nonconservative forces, characterized in that (c) the means in (b) are adapted to emit from the interaction region at least part of the accelerated beam that enters the interaction region, the emitted beam having substantially lower energy than the accelerated beam, and the apparatus further comprises (d) means for accelerating at least part of the beam emitted from the interaction region to an energy substantially greater than the energy of the beam after emission from the interaction region.

15. Apparatus of claim 14, wherein the means for subjecting in an interaction region the accelerated beam to nonconservative forces are positron moderating means.

16. Apparatus of claim 15, wherein the positron moderating means is an activated monocrystalline moderator.

17. Apparatus of claim 16, wherein the activated monocrystalline moderator is a Cu(111)+S moderator.

18. Apparatus for producing quasi-monoenergetic positron pulses, the apparatus being adapted to being traversed by the positrons in a longitudinal direction from an entrance side to an exit side, the apparatus comprising (a) means for maintaining a substantially uniform constant longitudinal magnetic field $B_o$ in a region of the apparatus comprising a drift region, (b) means for maintaining a constant longitudinal magnetic field $B_m > B_o$ throughout a part of the drift region, thereby maintaining a magnetic mirror, (c) an RF cavity, driven at the positron cyclotron resonance frequency, the cavity being located in the drift region at the exit side of the magnetic mirror, the cavity being adapted to impart only transverse energy to the positrons that pass through the cavity, (d) electrical means for repelling positrons of longitudinal energy less than a predetermined energy $\epsilon_l$, the means being located in the drift region at the exit side of the RF cavity, (e) means for applying a time-varying potential along an acceleration region, the acceleration region being located at the exit side of the electrical means for repelling charged particles, characterized in that the apparatus further comprises (f) means for subjecting positrons in an interaction region to nonconservative forces.

* * * * *